US005678815A

United States Patent [19]

Sheng

[11] Patent Number: 5,678,815

[45] Date of Patent: Oct. 21, 1997

[54] SHEET FEEDER

[75] Inventor: Thomas Sheng, Hsin-Chu, Taiwan

[73] Assignee: Avision Inc., Hsin-Chu, Taiwan

[21] Appl. No.: 822,470

[22] Filed: Mar. 24, 1997

Related U.S. Application Data

[63] Continuation of Ser. No. 622,572, Mar. 25, 1996, abandoned.

[51] Int. Cl.[6] ..... B65H 5/00

[52] U.S. Cl. ..... 271/10.13; 271/114; 271/270

[58] Field of Search ..... 271/10.11, 10.13, 271/114, 116, 270

[56] References Cited

U.S. PATENT DOCUMENTS

| | | | |
|---|---|---|---|
| 5,116,038 | 5/1992 | Kim | 271/270 X |
| 5,240,239 | 8/1993 | Kim | 271/10.11 |
| 5,480,132 | 1/1996 | Kiyohara et al. | 271/114 X |

FOREIGN PATENT DOCUMENTS

| | | | |
|---|---|---|---|
| 2664247 | 1/1992 | France | 271/114 |
| 225037 | 9/1988 | Japan | 271/114 |
| 26623 | 2/1991 | Japan | 271/114 |
| 177239 | 8/1991 | Japan | 271/114 |
| 238242 | 10/1991 | Japan | 271/114 |
| 94334 | 3/1992 | Japan | 271/114 |

*Primary Examiner*—Boris Milef
*Attorney, Agent, or Firm*—H. C. Lin

[57] ABSTRACT

An automatic document feeding device has a document feeding roller which feeds a document from a stack to a conveying roller which conveys the document for further processing. The document feeding roller has intermittent motion which feeds the conveying roller with three different speeds: first, at a first speed for feeding the document; then, at a speed faster than the first speed as dragged by the document; and finally, a temporary stop. The temporary stop provides sufficient interspace between the successive documents so that a correct pagination signal is generated. The intermittent motion is provided by a power transmitting component which is coupled to the document feeding roller to speed it up when engaged and is decoupled during the stop interval. The power transmitting component can be coupled to the document feeding roller (1) by kicking a pin on the shaft of the transmitting component with a shape edge of the document feeding roller, (2) by impacting a flat surface on the shaft of the transmitting component with a V-shaped protrusion attached to the document feeding roller, and (3) by impacting a flat surface on the shaft of the transmitting component with another flat surface attached to the document feeding roller.

6 Claims, 8 Drawing Sheets

SHEET FEEDER

This application is a continuation, of application Ser. No. 08/622,572, filed Mar. 25, 1996, now abandoned.

FIELD OF THE INVENTION

The present invention relates to an automatic document feeding device, especially to an automatic document feeding device which generates correct pagination signals.

BACKGROUND OF THE INVENTION

The automatic document feeding device (ADF) is a useful device for documenting image input system such as facsimile machines, image scanner and copying machines. In the application of the so-called "Paper-Feed" image input device, the automatic document feeding device functions to transport page by page documents containing image data into the scanning area of the image input device.

FIG. 1 shows the basic structure of an automatic feeding device. As shown in the figure, the automatic document feeding device comprises a document feeding roller 1 and a retard pad 3. The retard pad 3 is pressed against the document feeding roller 1 by a pressure spring 3b. A stack of documents 7 are mounted on top of the document feeding roller 1.

In an automatic document feeding device as shown in FIG. 1, the friction coefficient of the document feeding roller $\mu_R$ is greater than the friction coefficient of the friction pad $\mu_{pd}$, which is greater than the friction coefficient of the document $\mu_P$. In other words, $\mu_R>\mu_{pd}>\mu_P$.

When the document feeding roller 1 starts to rotate, a document 7 at the bottom of the stack of the documents is fetched by the document feeding roller 1 to the retard pad 3, since $\mu_R>\mu_P$. Because $\mu_{pd}>\mu_P$, all documents other than the one at the bottom of the stack are stopped by the retard pad 3. Only the document at the bottom of the stack is transported from the retard pad 3 by the document feeding roller 1. As a result, the documents are transported to the conveyor roller 9 page by the feeding roller 1.

Pagination sensor 8 has a sensing arm 8a. When the trailing edge of the document passes through the sensing arm 8a and the leading edge of the following document has not reached the sensing area of the sensing arm 8a, due to gravity or by means of a spring, the sensing arm 8a falls down and triggers a switch (not shown) to generate a pagination signal.

In the conventional device described above, when the trailing edge of the document 7 at the bottom (i.e. the first document) passes through the sensing arm 8a, the leading edge of the following document (i.e. the second document) follows it without an interspace. There is not enough space between the two documents for the sensing arm 8a to sense the down-stream end of the first document and to generate a pagination signal to the control device of the system. As a result, the pagination of the documents does not function correctly. Correction of the pagination is necessary in the processing of the documents.

To solve this problem in the conventional art, an electric clutch 10 is positioned between the power transmitting component 4 of the document feeding roller 1 (such as a dynamic gear) and the shaft 2 of the document feeding roller 1, as shown in FIG. 2. When a certain amount of time after the leading edge of a document 7 turns on a switch at the sensing arm 8a and the document is engaged by the conveyor roller 9, the system controller (not shown) turns off the electric clutch 10, rendering the shaft 2 of the document feeding roller 1 to disengage the power transmitting component 4. At this time, the document feeding roller 1 and the power transmitting component 4 are said to be at a "floating" position. At this floating position, the document feeding roller 1 is dragged by the first document 7, which is then conveyed by the conveyor roller 9.

When the trailing edge of the first document 7 is conveyed past the sensing arm 8a and the sensing arm 8a generates a pagination signal to the system controller, the system controller generates a signal to the electric clutch 10 to engage the document feeding roller 1 with the power transmitting component 4 and the second document is fed forward to sensing arm 8a.

In the conventional device described above, the electric clutch 10 occupies a large space, as its outer diameter may be larger than 25 mm. This problem makes it difficult to reduce the size of the document feeding device. Furthermore, the cost of the electric clutch is rather high.

SUMMARY

An object of this invention is to provide an automatic document feeding device that generates correct pagination signals during the document feeding procedure. Another object of this invention is to provide a compact automatic document feeding device. Still another object of the present invention is to provide an inexpensive automatic document feeding device.

An automatic document feeding device comprises a document feeding roller which separates documents stacked in a pile or a tray and feeds the document one by one toward the conveyor roller. The conveyor roller transports the document for further processing. The document feeding roller is rotated at a circumferential speed lower than that of the conveyor roller with the aid of a power transmitting component, which is coupled to the shaft of the document feeding roller. The torque of the power transmitting component is transmitted to the document feeding roller before the conveyor roller starts conveying a document, so that the document feeding roller is dragged for rotation of the document after the conveyor roller has started conveying the document. With the combination of the coupling means and the power transmitting component, which stops the document feeding roller for a period of time after the trailing edge of the first document has left the document feeding roller. The temporary stop of the document feeding roller provides sufficient interspace between successive documents, so that a correct pagination signal is generated.

Figure 4:
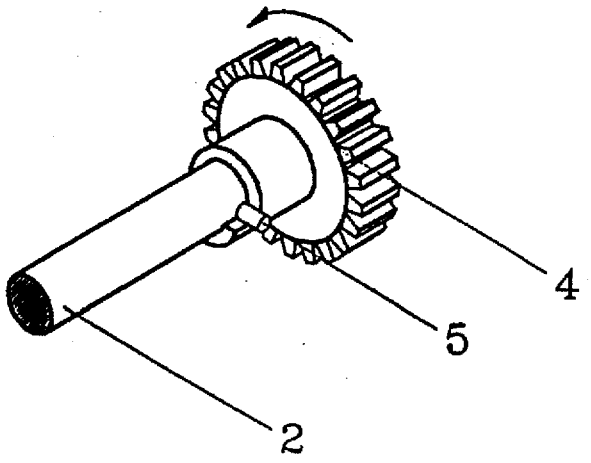
FIG. 4 shows the power transmitting system applicable to one embodiment of the automatic document feeding device of this invention.
Figure 7:
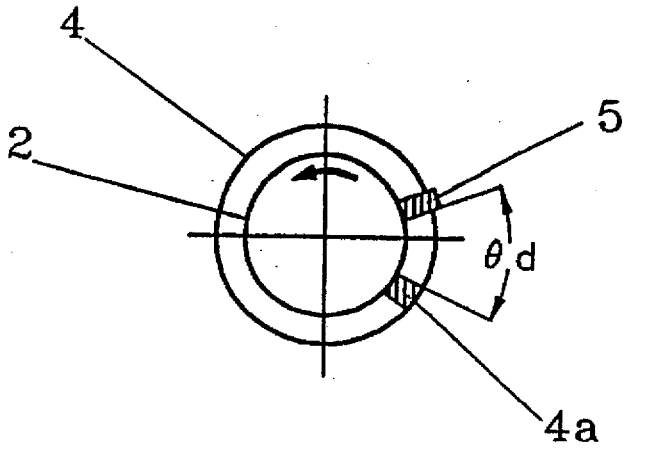

FIG. 7 shows the relative position between the power transmitting component and the coupling means of FIG. 4 at the moment when the trailing edge of the document is separated from the document feeding roller.

Figure 8:
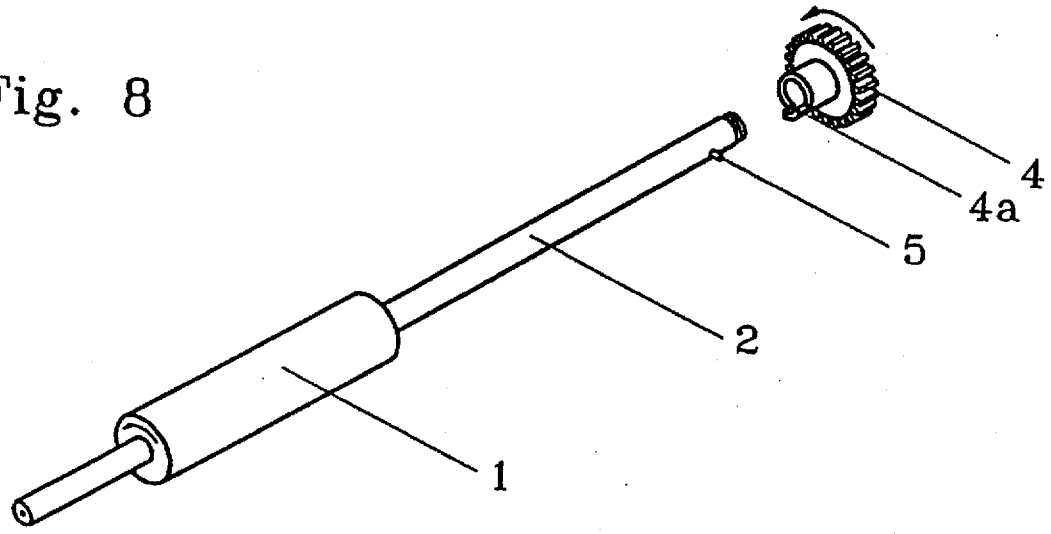

FIG. 8 shows the exploded view of the power transmitting system of FIG. 4.

Figure 9:
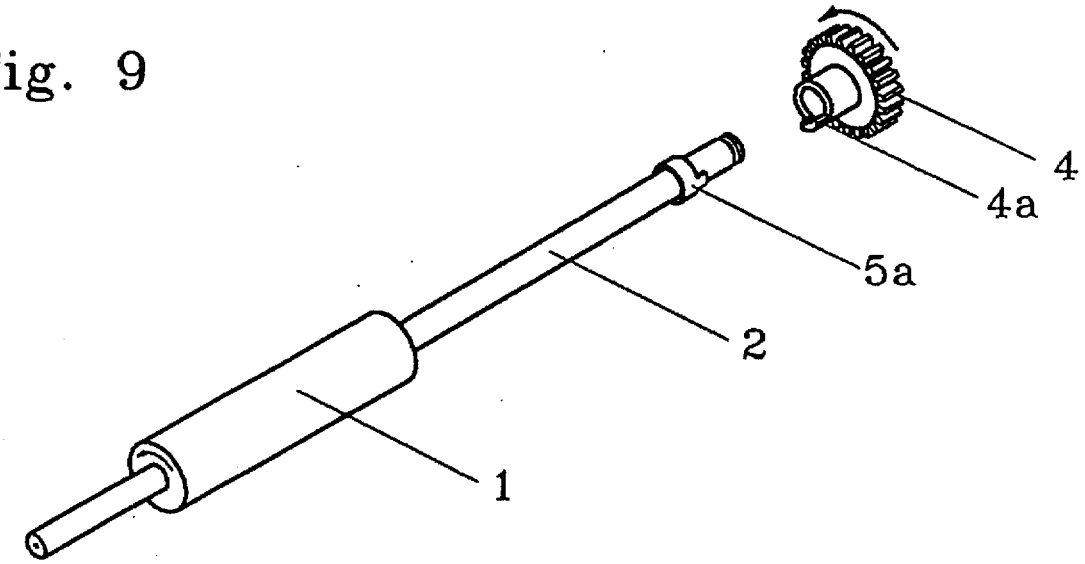

FIG. 9 shows the exploded of another power transmitting system of this invention.

Figure 10A:
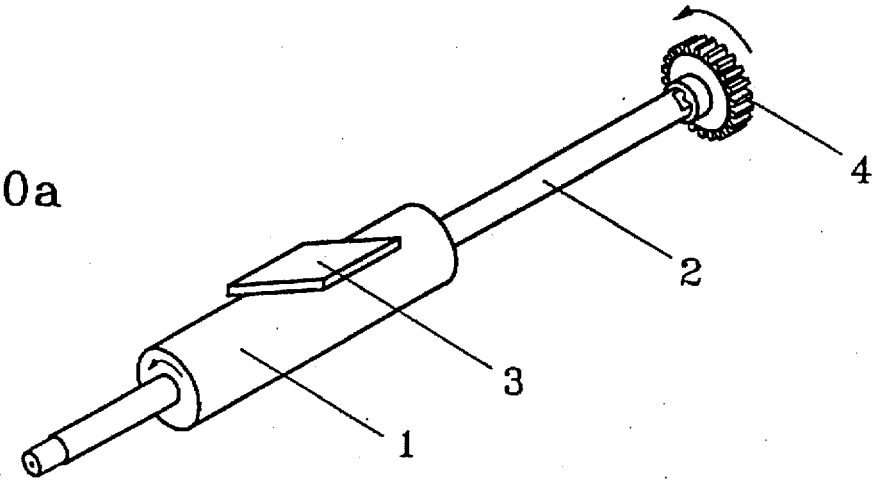
Figure 10B:
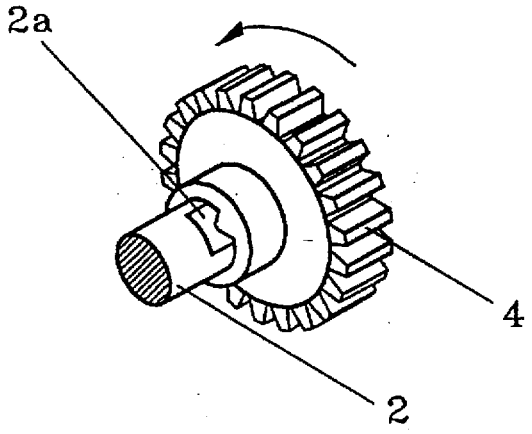
Figure 10C:
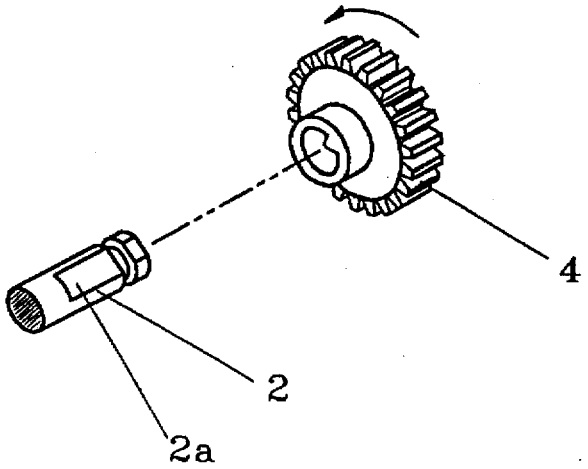

FIG. 10-*a*, FIG. 10-*b* and FIG. 10-*c* show another embodiment of the present invention.

Figure 11A:
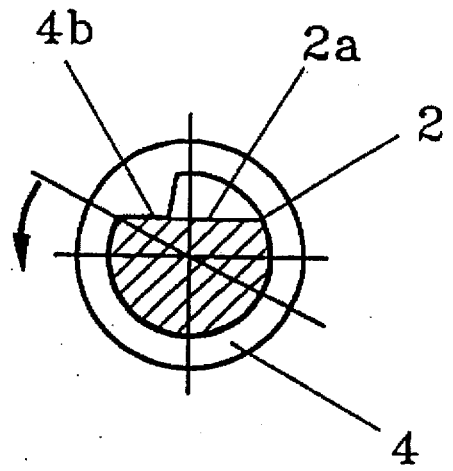
Figure 11B:
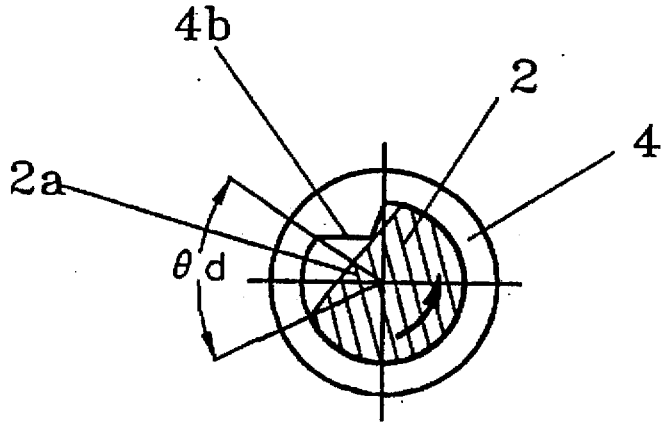

FIG. 11-*a* and FIG. 11-*b* show how the embodiment shown in FIGS. 1O-*a*, 10-*b* and 10-*c* generates the relative stop angle.

Figure 12A:
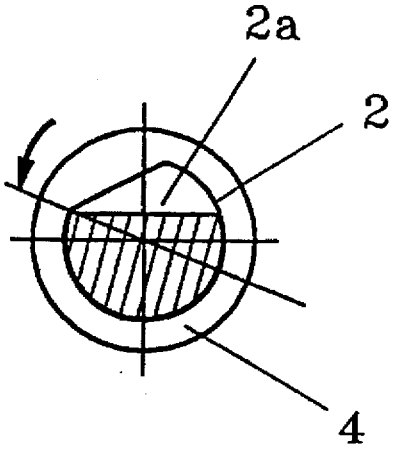
Figure 12B:
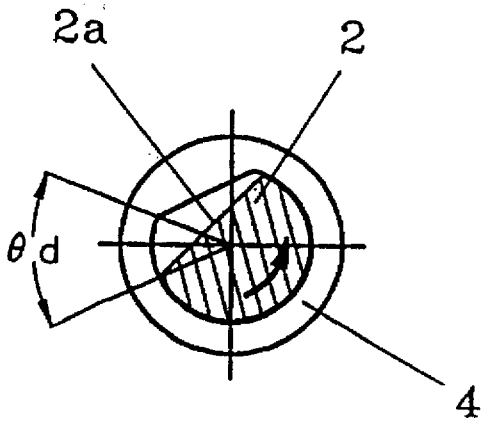

FIG. 12-*a* and FIG. 12-*b* show a third embodiment of the present invention.

DETAILED DESCRIPTION OF PREFERRED EMBODIMENTS

Figure 1:
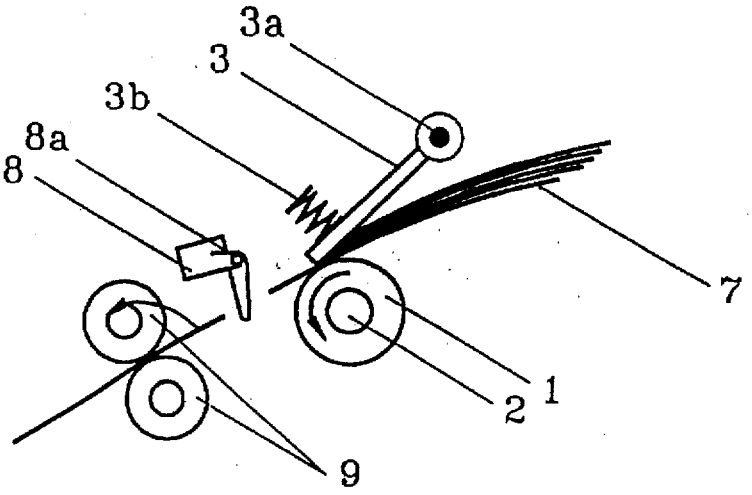
Fig. 1 Prior Art
FIG. 1 shows that basic system diagram of an automatic document feeding device.
Figure 2:
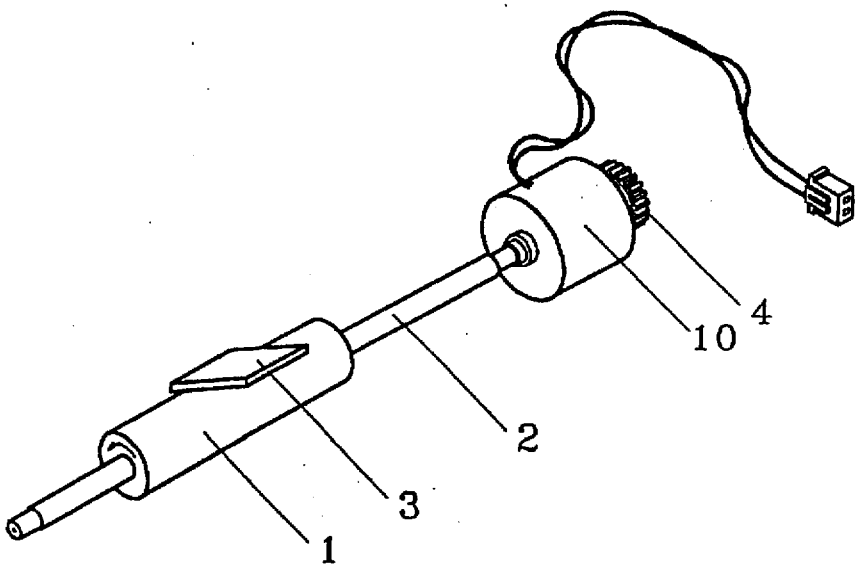
Fig. 2 Prior Art
FIG. 2 shows the structure of conventional automatic feeding device.
Figure 3:
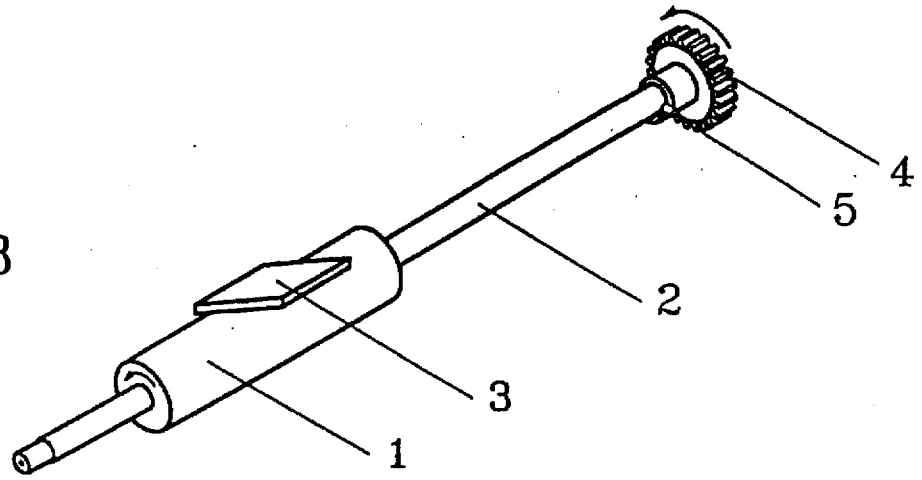
FIG. 3 shows the structure of an embodiment of an automatic document feeding device of this invention.

FIG. 3 shows the structure of the first embodiment of the automatic document feeding device of this invention. In this figure, components corresponding to those in FIGS. 1 and 2 are labeled with the same reference numbers. As shown in this figure, the automatic document feeding device of this invention includes a document feeding roller 1 with a shaft 2, a retard pad 3, a power transmitting component 4 which transmits the power from the power source (not shown) to the document feeding roller 1. In this embodiment, the shaft 2 and the document feeding roller 1 are integrated as one components.

The retard pad 3 is rotatably mounted above the document feeding roller 1 with a pivot 3*a* and is pressed against the document feeding roller 1 by a pressure spring 3*b* (referring to FIG. 1). The power transmitting component 4 is mounted on the shaft 2 and is rotated in the direction of the arrow in FIG. 3. An E-type snap ring, not shown, is fitted on the shaft 2 to retain the power transmitting component 4 and is constructed as a bushing in this embodiment. The coupling means 5 is positioned on the shaft 2 and is constructed as a pin in this embodiment. When the power transmitting component 4 rotates in the direction of the arrow in FIG. 3, a blocking means 4*a* on the power transmitting component 4 engages with the coupling means 5 so that a torque is transmitted to the document feeding roller 1. Consequently, the document feeding roller 1 is rotated in the same direction as the power transmitting component 4.

Figure 5:
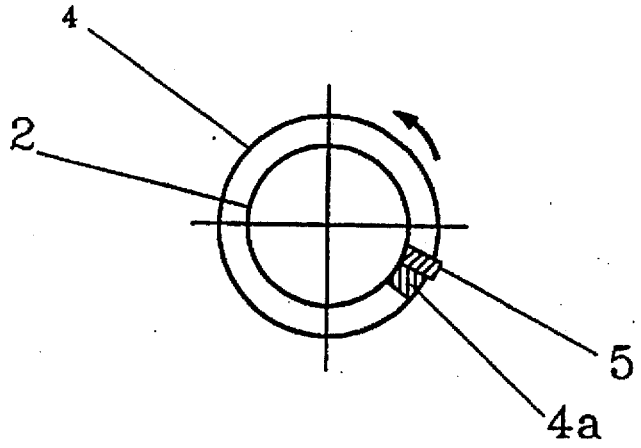
FIG. 5 shows the sectional view of the relative position between the power transmitting component and the coupling means of FIG. 4, when the document feeding roller is rotated by the power transmitting component.
Figure 6:
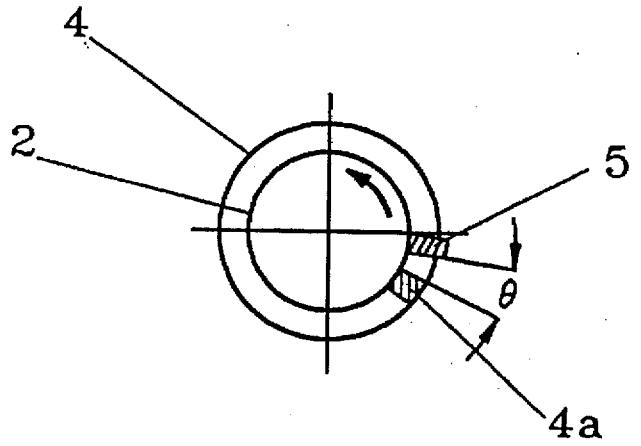
FIG. 6 shows the relative position between the power transmitting component and the coupling means of FIG. 4 when the document feeding roller is dragged by the document which is being fed by the conveyor roller.

Referring to FIGS. 5, 6 and 7, during operation, the document feeding roller 1 is driven for rotation in the direction of the arrow separates the document 7 at the bottom of the stack (i.e. the first document) with the retard pad 3, and delivers the document 7 to the conveyor roller 9.

When the leading edge of the document is nipped by the conveying roller 9 while the document 7 is being fed by the document feeding roller 1, the document 7 starts moving at a conveying speed, namely, the circumferential speed of the conveyor roller 9 which is higher than that of the document feeding roller 1. Hence, the rotating speed of the document feeding roller 1 exceeds that of the power transmitting component 4. Consequently, the coupling means 5 is kicked away by an angle θ from the blocking means 4*a* of the power transmitting shown in FIG. 6.

The relative angle θ as shown in FIG. 6 is increasing while the document feeding roller 1 dragged by the document 7 which is fed by the conveyor roller 9, and this increasing of the relative angle θ stops at an angle $\theta_d$ when the trailing edge of the document 7 is separated from the document feeding roller 1 as shown in FIG. 7. Once the trailing edge of the document 7 is separated from the document feeding roller 1, the document feeding roller 1 stops rotating, since the power transmitting component 4 cannot transmit the torque to the shaft 2 due to the relative angle $\theta_d$. As a result, the second document is not delivered by the document feeding roller 1 and remains at its original position.

However, the power transmitting component 4 is continuously rotating while the document feeding roller 1 remains stationary as described before. When the blocking means 4*a* shown in FIG. 8 of the power transmitting component 4 rotates to an angle $\theta_d$ and engages the coupling means 5, the document feeding roller starts to rotate again and delivers the second document foward to conveyor roller 9. The process of FIG. 5 and FIG. 7 is repeated until all the documents of the stack are delivered.

FIG. 9 shows the another example of the power transmitting system of this invention with a different type of coupling means. A bushing type of coupling means instead of a pin type coupling means is positioned on the shaft 2 of the document feeding roller 1.

As described above, during the time when the document feeding roller 1 stops rotating, the first document 7 is being conveyed by the conveyor roller 9, so that the first and second documents are conveying with an increased intersperse Δds there between. The interspace Δds can be calculated with the following equation:

$$\Delta ds=\pi D\theta d$$

where D is the diameter of the document feeding roller and $\theta_d$ is the relative stop angle between the power transmitting component 4 and the coupling means 5 as shown in FIG. 7.

The following is an example to calculate the interspace Δds and the relative stop angle $\theta_d$, and to get a better understanding of this invention: Let both the document feeding roller 1 and the conveying roller 9 have the same angular velocity, which means that both rollers take the same period of time Tr to rotate once around, and the circumferential speed of the rollers are proportional to the diameter of the rollers. Let the diameters of the document feeding roller 1 and conveyor 9 be 15.5 mm and 16.2 mm respectively. It is obvious that the circumferential speed of conveyor roller 9 is higher than that of the document feeding roller. During the period of time Tr, the length of the document fed by the document feeding roller 1 is $d_1$. Thus, $$d_1=D_1\times\pi=15.5\times3.14=48.7\ mm,$$

where $D_1$ is the diameter of the document feeding roller 1. Once the document is nipped by the conveyor roller 9 during the same period of time Tr, the document is transported a distance $$d_2=D_2\times\pi=16.2\times3.14=50.9\ mm$$

where $D_2$ is the diameter of the conveyor roller 9.

$$\Delta d=d_2-d_1=2.2\ mm$$

where Δd is the distance of the document feeding roller 1 dragged forward by the conveyor roller 9 during the time period Tr when the document is fed by both rollers.

Let the length of the document be 297 mm, which is the most popular A4 paper size. When the trailing edge of this document is separated from the document feeding roller 1, the difference in distance Δd is Δds, $$\Delta ds = [(297 - D_3)/d_2] \times \Delta d$$
$$= [(297 - 40)/50.9] \times 2.2 = 11.1 \text{ mm.}$$

where $D_3$ is the distance between the document feeding roller 1 and the conveyor roller 9, which is given as 40 mm.

Referring to FIG. 7, it is understood that Δds is the distance of the document feeding roller when rotated by an angle $\theta_d$. On the other hand, Δds is also the interspace between the trailing edge of the preceding document and the leading edge of the succeeding document while the document is being conveyed. Based on practical experience, the reliable interspace which generates accurate pagination signal is 5 mm, so the above calculated Δds is a conservative figure. The relative stop angle $\theta_d$ of this example is calculated as:

$$\theta_d = (ds/\pi D_1) \times 360° = 82°$$

From the example, it can be seen that the relative stop angle $\theta_d$ can the specified by the factors of the diameter of the document feeding roller and the difference in speed of the two rollers.

A third embodiment of this invention is shown in FIGS. 10-*a*, 10-*b* and 10-*c*. There is a flat surface 2*a* at the end of shaft 2 of the document feeding roller 1, and the transmitting component 4 has a V-shaped opening mounted on the end of the shaft 2 of the document feeding roller 1. When the power transmitting component 4 rotates in the direction of the arrow, the surface 4*b* of the V-shaped opening of the transmitting component 4 engages the surface 2*a* of the shaft 2 (as shown in FIG. 11-*a*) so that a torque is transmitted to the document feeding roller 1. Consequently, the document feeding roller 1 is rotated in the same direction as the power transmitting component 4.

During operation, the document feeding roller 1 is driven for rotation in the direction of the arrow, separates the document 7 at the bottom of the stack with the retard pad 3, and delivers the document 7 to the conveyor roller 9.

When the leading edge of the document is nipped by the conveying roller while the document 7 is being fed by the document feeding roller 1, the document 7 starts moving at the circumferential speed of the conveyor roller 9 which is higher than that of the document feeding roller 1. Hence, the rotating speed of the document feeding roller 1 exceeds that of the power transmitting component 4. Consequently, the surface 2*a* of the shaft 2 is kicked away from the surface 4*b* of the V-shaped opening of the transmitting component 4. When the trailing edge of the document 7 is separated from the document feeding roller 1, the relative angle stops at an angle $\theta_d$ as shown in FIG. 11-*b* and the document feeding roller 1 stops rotating. As described before, the relative stop angle $\theta_d$ stops the document feeding roller 1 at a fixed time, so that the first and the second documents are conveying with an increased interspace $\Delta d_s$ there between.

FIGS. 12-*a* and 12-*b* show a further example of the opening on the power transmitting component 4. The opening on the power transmitting component 4 is a flat surface instead of being V-shaped. When the power transmitting component 4 rotates in the direction of the arrow, one side of the opening of the transmitting component 4 engages with the surface 2*a* of the shaft 2 (as shown in FIG. 12-*a*) so that a torque is transmitted to the document feeding roller 1. The rest of the description of this embodiment is the same as the third embodiment.

As is apparent from the foregoing description, the automatic document feeding device of the present invention employs the foregoing simple mechanism for conveying documents with an increase interval between the trailing edge of the preceding document and the leading edge of the succeeding sheet. This mechanism enables the generation of an accurate pagination signal while the documents are being conveyed. The detailed description given here and the accompanying drawings are illustrative of the mechanism and are not limited to these particular embodiments.

While the foregoing description discloses three different embodiments of this invention, the key idea is to provide different speeds for feeding the document and for conveying the document. Any mechanism to provide such an action is considered to be within the scope of this invention.

What is claim is:

1. An automatic document feeding device, comprising:

a document feeding roller for feeding documents one by one, a conveyor roller for conveying documents fed by said document feeding roller;

said document feeding roller intermittently feeding said documents at a first speed less than the speed at which said conveyor roller conveys said documents, at a second speed higher than the first speed, and at a third speed equal to zero, so that the speed at which the document feeding roller feeds the document varies during the period at which one of said documents is fed;

a shaft on which said document feeding roller is supported:

a power transmitting component mounted on said shaft for rotating said document feeding roller at said first speed; and coupling means having a fixed single protrusion, non-rotatable with respect to said shaft, and fixed on said shaft so that torque is transmitted from said power transmitting component to said document feeding roller before the conveyor roller starts conveying each of said documents, wherein said automatic document feeding device is operable to feed said documents without the use of one-way clutch.

2. An automatic document feeding device as described in claim 1, wherein said coupling means and said document feeding roller stop for a period of time after the trailing edge of a document has left the document feeding roller.

3. An automatic document feeding device as described in claim 2, further comprising a pagination sensor for generating a pagination signal in response to the feeding of each of said documents.

4. An automatic document feeding device as described in claim 3, wherein said coupling means engages a blocking means on the power transmitting component.

5. An automatic document feeding device as described in claim 4 wherein said coupling means is a pin.

6. An automatic document feeding device as described in claim 4, wherein said coupling means is a bushing.

* * * * *